US005333745A

United States Patent [19]

Lehmann

[11] Patent Number: 5,333,745

[45] Date of Patent: Aug. 2, 1994

[54] MERCHANDISING DISPLAY UNIT

[76] Inventor: Paul F. Lehmann, 1855 N. Custer Rd., Monroe, Mich. 48161

[21] Appl. No.: 21,070

[22] Filed: Feb. 23, 1993

[51] Int. Cl.[5] ..... A47F 5/08

[52] U.S. Cl. ..... 211/88; 211/86; 211/184

[58] Field of Search ..... 211/88, 86, 184, 59.4, 211/126, 150, 94.5, 103, 94, 87; 40/642, 650

[56] References Cited

U.S. PATENT DOCUMENTS

| | | | |
|---|---|---|---|
| 1,552,510 | 9/1925 | Scofield . | |
| 1,554,137 | 9/1925 | Slifkin . | |
| 1,589,198 | 6/1926 | McComb . | |
| 1,594,754 | 8/1926 | Reines . | |
| 2,212,129 | 8/1940 | Rust . | |
| 2,733,113 | 1/1956 | Humbargar | 312/251 |
| 3,429,450 | 2/1969 | Lambert | 211/60 |
| 3,635,161 | 1/1972 | Leanna | 101/364 |
| 4,047,615 | 9/1977 | Browne | 211/88 |
| 4,154,356 | 5/1979 | Schieve | 220/18 |
| 4,403,700 | 9/1983 | Manlove | 211/88 |
| 4,560,072 | 12/1985 | Burrell | 211/75 |
| 4,669,208 | 6/1987 | Stoddard | 40/642 X |
| 4,962,860 | 10/1990 | Lehmann | 211/88 |
| 5,090,577 | 2/1992 | Lehmann | 211/86 |

FOREIGN PATENT DOCUMENTS

| | | |
|---|---|---|
| 1013297 | 7/1977 | Canada . |
| 1001938 | 2/1952 | France . |

*Primary Examiner*—Blair M. Johnson

*Attorney, Agent, or Firm*—Willian Brinks Hofer Gilson & Lione

[57] ABSTRACT

A merchandising display unit particularly suited for storing and displaying groups of small items of variable sizes. The basic unit includes an elongated horizontal channel having an arcuate wall cross-section extending substantially 180 degrees around the horizontal axis, a front and rear longitudinal edge and a supporting member receivable in an aperture formed within the channel. The front longitudinal edge terminates in a forward surface having a longitudinal guide track for slidably receiving and holding a label receptacle. The supporting member includes an elongated projection mating with an aperture of the channel to support the channel in a substantially horizontal position. Each end of the channel has a removable planar transverse end barrier. Each end barrier has a generally linear upper surface, and a generally arcuate lower periphery that is coextensive with the arcuate wall cross-section of the channel and has a projection extending normal to the planar wall with a diameter slightly larger than that of the channel. One or more dividers are transversely positioned between the end barriers to provide separate item compartments of desirable length.

10 Claims, 1 Drawing Sheet

MERCHANDISING DISPLAY UNIT

SUMMARY OF THE INVENTION

This invention is an improvement on my now issued U.S. Pat. No. 5,090,577 for a merchandising display unit. The invention includes a horizontally extending channel-shaped body of arcuate cross section in which the channel body extends through an arc about its horizontal axis of greater than 180 degrees to provide a partial enclosure and an open slot for access and visual inspection of the contents therein. The horizontal channel body includes arcuate slots or apertures which mate with an extrusion on vertical support brackets and is held in place by one or more suitable fasteners extending through the apertures of the channel and the corresponding hole of the vertical supports.

The front edge of the horizontal channel body has inwardly directed lips or lugs which form a guide track for holding an elongated holder member.

The extreme ends of the channels are closed by end caps which have an arcuate projection with a slightly larger circumference than the arcuate circumference of the channel so that they are firmly gripped when inserted at each end of the channel body.

The merchandising display unit includes horizontally adjustable dividers positioned between end caps which serve to separate the horizontal body into compartments for holding individual items such as hardware or other small items. The dividers are an arcuate shaped disk corresponding to the cross section of the channel body but have a slightly larger arcuate circumference than the corresponding arcuate circumference of the channel so that they are firmly gripped when inserted within the channel body.

FIELD OF THE INVENTION

It is an object of the present invention to provide a merchandising display unit of the type described in which movable dividers can be selectively positioned anywhere along the horizontal axis of the unit to form multiple individual compartments, end caps at each end of the channel unit, a longitudinal label holder and vertical mounting brackets.

It is another object of this invention to provide an end cap at each end of a merchandizing display unit, having an arcuate projection with a circumference slightly larger than that of the arcuate circumference of the channel unit, such that the end cap may be positioned transverse to the horizontal axis of the channel thereby stressing the channel unit walls to exert force on the divider to hold it in position by an interference fit.

It is another object of this invention to provide a longitudinal guide track at the forward edge of the merchandizing display unit for slidably receiving a label holder lengthwise along the guide track.

It is still another object of this invention to provide vertical mounting brackets. The brackets having a longitudinal projection utilized in connection with similarly configured arcuate slots formed within the display unit to facilitate mounting and stabilization of the display unit.

For further understanding of the present invention and the objects thereof, attention is directed to the drawings and the following brief description thereof, to the detailed description of the preferred embodiment, and to the appended claims.

DETAILED DESCRIPTION OF THE INVENTION

Figure 1:
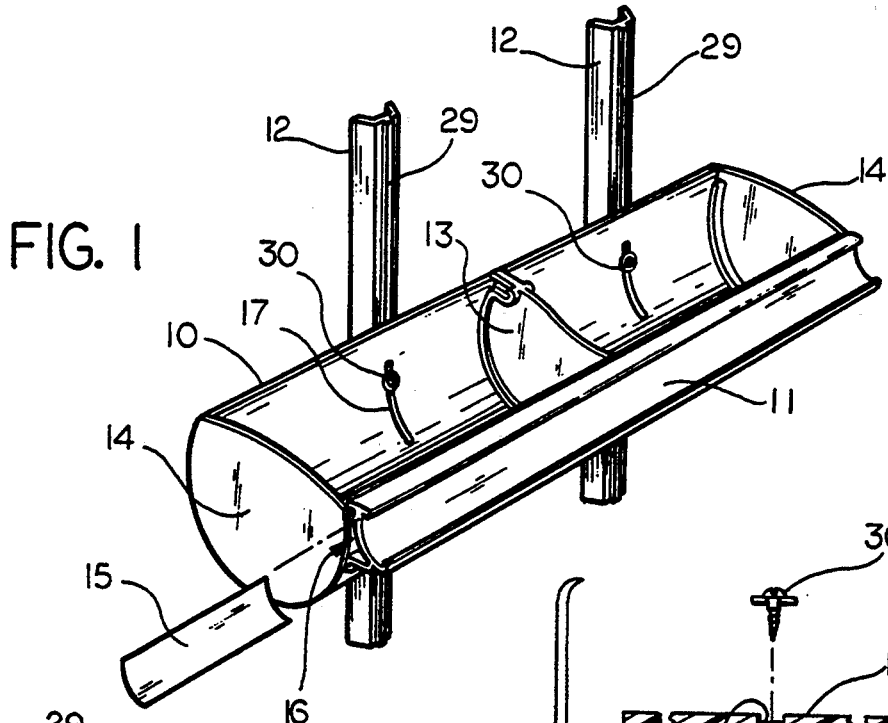
FIG. 1 is a view in perspective of the preferred embodiment of the merchandising display unit according to the present invention.

Referring to FIG. 1, each display unit consists of an elongate channel 10 preferably fabricated from a length of extruded plastic pipe, such as three to eight inch diameter polyethylene pipe which is commonly made for liquid transport. The advantages of using such pipe are several: it is relatively inexpensive, readily available, can be cut and custom installed with portable hand tools, and comes in different colors so that an attractive display can be built. A relatively unskilled worker such as a store clerk or general repair person, can easily master installation of these units.

As shown, the pipe has a slot of about 120 degrees so that the remaining arc of the pipe is sufficient to provide a partially enclosed channel to hold the units and yet the slot of 120 degrees provides enough space for a visual inspection of the contents and manual access thereto. The slot can vary between 90 and 120 degrees and still leave sufficient channel structure to keep parts from falling out, although at least 200 degrees is desirable at a minimum to grip the dividers and provide an enclosure to keep parts from falling out.

Figure 2:
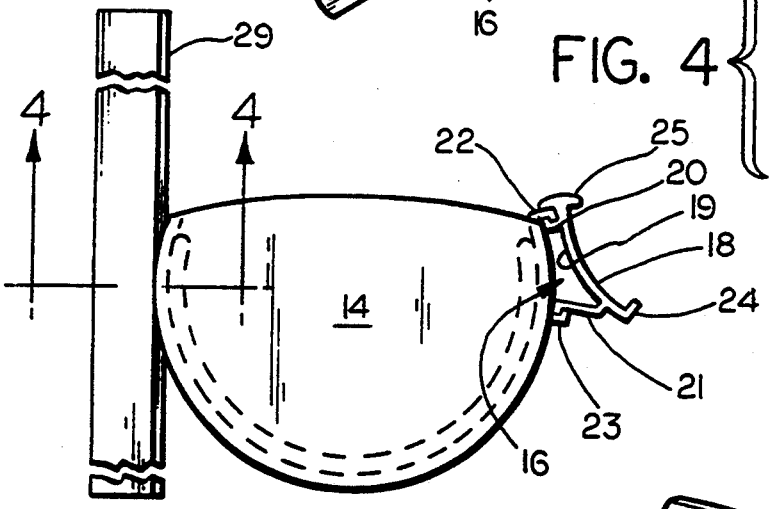
FIG. 2 is an end view of the unit of FIG. 1 showing the manner in which the merchandising display unit is attached to the vertical support brackets.

FIG. 2 is a cross-sectional view illustrating the utilization of the guide track 16 with the label receptacle 11. The label receptacle 11 is preferably formed of the same thermoplastic material and may be of the same length as the channel 10 with an arcuate front side 18 and back side 19. The back side 19 has continuous outwardly directed lips or lugs 20 and 21 which form a trackway that fits into the guide track 16. The front end of the channel arc has continuous inwardly directed lips or lugs 22 and 23 which form the guide track 16 for slidably receiving and holding the label receptacle 11 lengthwise along the display unit 10. The front side of the label receptacle 11 is constructed to slidably receive and hold a strip of material, as shown in FIG. 1, by means of right-angle flanges 24 and 25 along its horizontal edge so that contents in a particular portion of the display unit 10 may be labeled, priced and/or otherwise identified.

Figure 3:
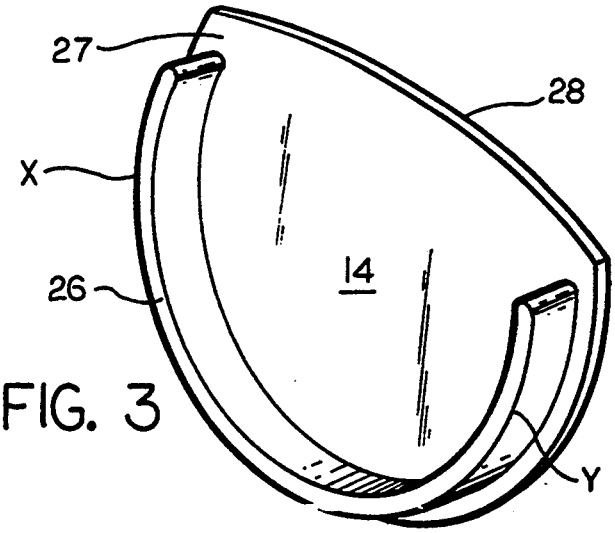
FIG. 3 is a view in perspective of one of the end caps.

As best seen in FIG. 1, the extreme ends of the channel 10 are closed by end caps 14. The end cap 14 is composed of preferably the same thermoplastic material as the channel 10. The end cap has a front side 27 and a backside 28. The front side 27 has an arcuate projection 26 with the circumference of the projection, measured between points X and Y, as shown in FIG. 3, is slightly larger than the unstressed arcuate circumference of the channel 10 so that when fully installed at the end of the channel 10, the end cap 14 is held in place and stresses the arcuate channel 10 which opens slightly to grasp the end cap projection 26 and maintains force on the end cap projection 26 to hold end cap 14 in position. As will be apparent, the force on the end cap projection 26 is exerted by opposed edges of the channel 10 which must extend substantially about 180° to maintain a grip on the end cap 14.

Intermediate the ends are a plurality of divider disks 13 which are positioned along the length of the channel 10 to separate the channel into individual compartments. The divider disks 13 have a thickness sufficient to prevent their twisting in the channel 10. For example, a disk of ⅜ inch material has been found to be satisfactory. The divider disks 13 may be adjusted to the exact length of the part being stored so that the display system is universal in that it can accommodate most any size part length. For example, if the display were to be used with bolts in a hardware store, each divider would be positioned so that the distance to an end cap 14 or another divider 13 would be exactly that necessary to receive a number of bolts of each particular length, placed in parallel horizontal position.

As shown in FIG. 1, the channel 10 is fastened to mounting brackets 12. The bracket 12 may be secured in position to any surface by means of fasteners such as screws or the like. The mounting brackets 12 are composed of preferably the same thermoplastic material as the channel 10 and may be of any desired length to accommodate a plurality of channels to be mounted thereon as previously described.

Figure 4:
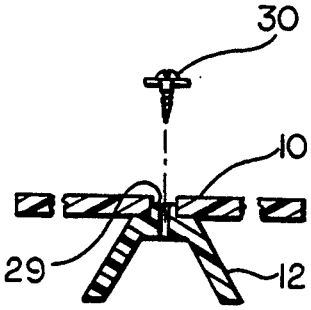
FIG. 4 is a top view taken along line 4—4 of FIG. 2 of the vertical support brackets and the display unit.

FIG. 4 is a cross-sectional view of the mounting bracket 12 which is in the form of a "c-shaped" channel having a longitudinal rise 29. The longitudinal rise 29 extends the length of the bracket 12 and is utilized in connection with the arcuate slot 17 at the back side of the channel 10 to secure the channel 10 to the mounting surface. It will be appreciated that this engaging-/mounting device consisting of bracket 12 in conjunction with channel 10 provides ready horizontal alignment and lateral stability of the channel 10.

It will be apparent to those skilled in the art that the invention described above provides a number of advantages over the prior art display fixtures. Firstly, because it may be fabricated from readily available lengths of thermoplastic pipe, a hardware store owner, clerk, or semi-skilled installer can easily fabricate the custom shelves. Secondly, because such pipes are available in a number of colors, attractive displays can be fabricated or the displays may be color coded to indicate different items in different colors, such as metric threads in one color and English standard threads in another, etc. Thirdly, the divider disks 13 and the end cap 14 can also be fabricated from inexpensive thermoplastic sheets of different colors so that the start of one type of part can be indicated by a color on each end, etc. Yet another advantage of this invention is the provision for mating the vertical mounting brackets with the slots of the display unit allowing for horizontal alignment and stabilization of the display unit.

Other advantages of the invention will be apparent to those skilled in the art and various changes may be made from the above-described embodiment, without departing from the scope and spirit of the following claims.

The documents, patent applications and patents identified herein are hereby incorporated by reference.

What is claimed is:

1. A merchandising display unit, comprising: an elongated channel of uniform diameter having an arcuate wall cross-section extending at least 180 degrees about a horizontal axis to form a partial enclosure having a front longitudinal channel edge and at least one arcuate aperture; and vertical mans for supporting said channel, said vertical support means including a rise formed integral with said support means and projecting from said support means through said aperture to support said channel.

2. The merchandising display unit of claim 1 further comprising at least one transverse end barrier with a planar wall extending through said arcuate wall cross-section of said channel, said transverse end barrier further including an arcuate projection extending normal to said planar wall and coextensive with said arcuate channel wall.

3. The merchandising display unit of claim 1 wherein said front longitudinal channel edge includes longitudinal inwardly extending ribs providing a guide track.

4. The merchandising display unit of claim 3 further comprising a label receptacle member having a concave label receiving face with lower and upper rearward extending longitudinal ribs of L-shaped cross sectional configuration with outwardly opposed ledges for sliding along said guide track, said lower rib extending further form the back side of said label receiving face than said upper rib.

5. A merchandising display unit comprising an elongated channel of uniform diameter having an arcuate wall cross-section extending at least 180 degrees about a horizontal axis to form a partial enclosure having a front longitudinal channel edge, a back longitudinal channel edge and at least one arcuate aperture; a guide track along said front longitudinal channel edge having longitudinal inwardly extending ribs; and a vertical means for supporting said channel, said vertical support means including a rise formed integral with said support means and projecting from said support means through said aperture to support said channel.

6. The merchandising display unit of claim 5 further comprising at least one transverse end barrier with a planar wall extending through said arcuate wall cross-section of said channel, said transverse end barrier further including an arcuate projection extending normal to said planar wall and coextensive with arcuate channel wall.

7. The merchandising display unit of claim 5 further comprising a label receptacle member having a concave label receiving face with lower and upper rearward extending longitudinal ribs of L-shaped cross sectional configuration with outwardly opposed ledges for sliding along said guide track, said lower rib extending further from the back side of said label receiving face than said upper rib.

8. A merchandising display unit comprising an elongate channel of uniform diameter having an arcuate wall cross-section extending at least 180 degrees about a horizontal axis to form a partial enclosure having a front longitudinal channel edge, a back longitudinal channel edge and at least one arcuate aperture; at least one transverse end barrier with a planar wall extending through said arcuate wall cross-section of said channel, said transverse end barrier further including an arcuate projection extending normal to said planar wall and coextensive with said arcuate channel wall; and a vertical means for supporting said channel, said vertical support means including a rise formed integral with said support means and projecting from said support means through said aperture to support said channel.

9. The merchandising display unit of claim 8 wherein said front longitudinal channel edge includes longitudinal inwardly extending ribs providing a guide track.

10. The merchandising display unit of claim 9 further comprising a label receptacle member having a concave label receiving face with lower and upper rearward extending longitudinal ribs of L-shaped cross sectional configuration with outwardly opposed ledges for sliding along said guide track, said lower rib extending further from the back side of said label receiving face than said upper rib.

* * * * *